US007166033B2

(12) United States Patent
Krajeski

(10) Patent No.: US 7,166,033 B2
(45) Date of Patent: Jan. 23, 2007

(54) BALL SETTING AND TIGHTENING RACK

(76) Inventor: Kenneth S. Krajeski, 5120 Lincoln Rd., Ontario, NY (US) 14519

( * ) Notice: Subject to any disclaimer, the term of this patent is extended or adjusted under 35 U.S.C. 154(b) by 0 days.

(21) Appl. No.: 10/963,861

(22) Filed: Oct. 13, 2004

(65) Prior Publication Data

US 2006/0079339 A1 Apr. 13, 2006

(51) Int. Cl.
*A63D 15/00* (2006.01)

(52) U.S. Cl. ..... 473/40

(58) Field of Classification Search ..... 473/40, 473/41, 26, 21, 1

See application file for complete search history.

(56) References Cited

U.S. PATENT DOCUMENTS

| | | | | | |
|---|---|---|---|---|---|
| 743,464 | A | * | 11/1903 | D'Abramo | 473/40 |
| 916,193 | A | * | 3/1909 | Pierce | 473/40 |
| 952,920 | A | * | 3/1910 | Meacham | 235/91 B |
| 1,660,626 | A | * | 2/1928 | Rhoads | 473/40 |
| 3,423,087 | A | | 1/1969 | Sowa | |
| 3,672,671 | A | | 6/1972 | Merola | |
| 3,863,919 | A | | 2/1975 | Sardelli | |
| 3,992,005 | A | | 11/1976 | Richey | |
| 4,553,750 | A | * | 11/1985 | Kintz | 473/40 |
| 5,556,341 | A | | 9/1996 | Bonn, Jr. | |
| 5,601,495 | A | | 2/1997 | Silverman | |
| 5,735,750 | A | | 4/1998 | Silverman | |
| 5,997,404 | A | | 12/1999 | Sardo | |
| 6,312,342 | B1 | | 11/2001 | Newsome | |
| 6,595,862 | B1 | | 7/2003 | Porper | |

* cited by examiner

*Primary Examiner*—Mitra Aryanpour
(74) *Attorney, Agent, or Firm*—Patent Technologies, LLC; Robert D. Gunderman, Jr.

(57) ABSTRACT

An improved ball setting and tightening rack for creating a compact formation of playing balls on a playing surface that is used for playing billiards, pool, snooker, or any other game requiring a tight grouping of playing balls on a playing surface. The improved ball setting and tightening rack contains a mechanism for both creating a compact formation of playing balls and for aiding in the removal of the rack from the compacted formation of playing balls without disturbing the compacted balls. The improved ball setting and tightening rack uses horizontal compression to create a compact formation of playing balls, thus reducing wear on the playing surface. The improved ball setting and tightening rack also fits in a standard rack holder or rack slot such as the rack holders or rack slots found in billiard halls.

9 Claims, 12 Drawing Sheets

BALL SETTING AND TIGHTENING RACK

BACKGROUND OF THE INVENTION

1. Field of the Invention

This invention relates generally to the games of billiards, pool and snooker, and more particularly to an apparatus for tightly setting and arranging billiard, pool or snooker balls on the surface of a playing table.

2. Description of the Prior Art

In the games of billiards, pool, and snooker, the playing balls are arranged in a pre-determined pattern at the start of the game. In the game of pool, for example, fifteen balls are arranged in a triangular pattern using a triangular shaped frame known as a rack. The balls are placed in a triangular formation at a given spot on the playing surface, and the rack is removed. Once the rack is removed from the balls, the formation is broken by a player propelling a cue ball in such a manner as to disperse the formation of balls across the playing surface. The way in which the formation of balls is broken is of utmost importance to how the ensuing game progresses. It is very desirable to compact the formation of balls such that they are set tightly together. The act of compacting the formation of balls such that they are set tightly together is commonly known as "tightening". This technique allows for the maximum transfer of energy from the cue ball to the balls in formation, and provides a disperse spread of balls across the playing surface. There are various techniques used to compact the formation of balls contained by the rack, the simplest being the use of a player's fingers to push the balls forward in the rack once the balls are contained by the rack. The problem with this technique is with the adhesion that occurs between a player's fingers and the playing balls. The surface adhesion that momentarily occurs when a player removes their fingers from the playing balls serves to disturb the compact formation of balls within the rack. Another problem occurs when the rack is removed from the formation of balls. Upon removal of the rack from a compact formation of balls, there exists the possibility that the rack inadvertently comes into contact with one or more of the playing balls and disturbs the previously compact formation of balls. Such a disturbance can negatively impact the breaking of the formation, or can further result in resetting and retightening the formation prior to the start of play.

The prior art has disclosed various techniques for creating a compact formation of playing balls using various means to tighten the playing balls. Reference may be had, e.g., to U.S. Pat. No. 3,672,671 that uses inclined walls within the rack to create downward pressure on the playing balls. Reference may also be had to U.S. Pat. No. 6,595,862 that uses similar inclined walls within the rack to create downward pressure on the playing balls, and further uses lifting levers to ensure that the compact formation of playing balls is not disturbed upon removal of the rack. U.S. Pat. Nos. 5,601,495 and 5,735,750 further use inclined walls to create downward pressure on the playing balls, and use springs to push the rack upward and away from the playing balls once the formation is compacted. U.S. Pat. No. 5,556,341 uses angled packing bars to create downward pressure on the playing balls. There further exists U.S. Pat. No. 5,997,404 that discloses the use of individual pressure pins to create downward pressure on each individual playing ball. Each of these referenced United States Patents describe the use of downward pressure to press the playing balls into the felt of the playing surface. The use of downward pressure of the playing balls into the felt of the playing surface causes wear and fatigue of the playing surface felt, resulting in a playing surface with uneven ball rolling characteristics and premature failure and subsequent replacement of the felt playing surface. The present invention improves upon the attributes of the prior art compression racks by using horizontal pressure to compact the arrangement of playing balls, thus eliminating concerns over the wear and fatigue of the felt of the playing surface.

Reference may further be had to U.S. Pat. No. 3,992,005 that discloses a rack that uses horizontal pressure to compact the playing balls. The rack disclosed uses a ball and socket arrangement such that one corner of the rack triangle pops open upon insertion of the last ball. A problem with such a ball and socket release mechanism is one of vibration whereas the potential exists for the playing balls to be disturbed as the one corner of the rack triangle pops open automatically. Another problem with the use of horizontal compression from a single geometric plane, as described in U.S. Pat. No. 3,992,005 arises from the potential lack of size uniformity of the playing balls, as described in U.S. Pat. No. 5,997,404: "Unfortunately, the size of the pool balls often lacks uniformity, which makes it difficult to properly rack the balls into a tight formation." The present invention solves the aforementioned problems by using slide mechanisms to reduce the length of the sides of the rack, and thus apply horizontal compression in both horizontal geometric planes, therefore compensating for any variation in ball size. The present invention further employs a hinge and slide mechanism to completely open one side of the rack, without any risk of disturbing the compacted playing ball formation.

The prior art references cited above use various mechanical means to compress the formation of balls within the rack. A further drawback to the prior art is the resulting shape of the rack. There are many devices in use today to retain and store a standard rack. These devices include retainers for securing racks in a commercial pool hall, holders for retaining accessories such as cue sticks, racks, chalk, and balls, carrying cases for racks, and the like. Many of the racks referenced in the prior art have a shape that does not conform to the shape of a typical rack. This precludes the use of such prior art racks with most rack retention and storage devices. The present invention conforms to the geometry of a typical rack, thus allowing the use of the present invention with most rack retention and storage devices.

It is an object of the present invention to provide an improved rack for compacting a formation of playing balls using horizontal pressure.

It is another object of the present invention to provide an improved rack for compacting a formation of playing balls and allowing for removal of said rack without disturbing the formation of playing balls.

It is another object of the present invention to provide an improved rack for compacting a formation of playing balls whereas the improved rack fits in a standard rack holder or rack slot such as the rack holders or rack slots found in billiard halls.

These and other objects of the invention will be apparent from the discussion appearing in the remainder of this specification.

BRIEF SUMMARY OF THE INVENTION

In accordance with the present invention, there is provided an apparatus for arranging and compacting a plurality of balls into a predetermined pattern comprising a frame with a first side wall, a second side wall and a third side wall, and a slide mechanism attached to at least one side wall for changing the length of at least one side wall.

In using the present invention, one places a plurality of balls within the confines of said apparatus and reduces the length of at least one side wall by pushing at least one side wall toward the plurality of balls such that the plurality of balls are arranged and compacted into a predetermined pattern. The apparatus uses horizontal compression along both the x-axis and the y-axis to create a tight grouping of playing balls. The use of horizontal compression in place of the more common vertical compression racks provides a tighter grouping of playing balls and also reduces wear, fatigue and subsequent failure of the playing surface.

One embodiment of the present invention may include a slideable hinge mechanism pivotally attached to at least one side wall to allow at least one side wall to be raised above the height of said plurality of balls. By raising at least one side wall above the height of the plurality of balls, the apparatus may be slid away from the compact grouping of balls without disturbing the compact grouping of balls.

Another embodiment of the present invention may include tabs to facilitate hand retention of said apparatus.

Other features and advantages of the present invention will become apparent from the following more detailed description provided with the accompanying drawings.

BRIEF DESCRIPTION OF THE DRAWINGS

The invention will be described by reference to the following drawings, in which like numerals refer to like elements, and in which.

Figure 1:
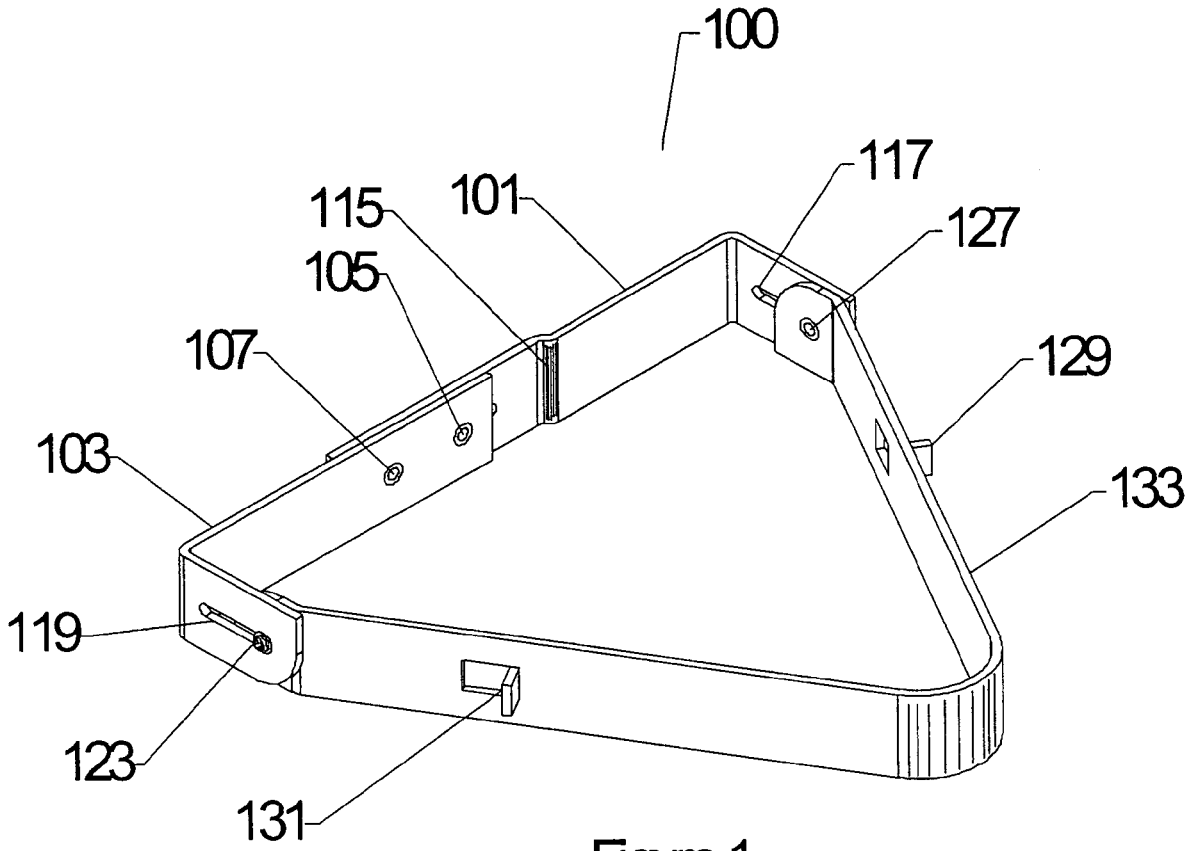
FIG. 1 is a perspective view of a ball setting and tightening rack according to one embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements. As shown in the drawings for purposes of illustration, the present invention is directed to a billiard ball rack for tightly setting and arranging a formation of billiard balls on a playing table. For the purposes of illustration, the drawings illustrate a 15 ball billiard rack, however the spirit and scope of the present invention includes variations of the game of billiards such as 9 ball, snooker, pool, and the like.

FIG. 1 is a perspective view of a ball setting and tightening rack according to one embodiment of the present invention. Referring to FIG. 1, a rack assembly 100 is shown. The rack assembly 100 is made of a plurality of side walls that form a geometric shape such as a triangle. A compound side wall 133 makes up the first side wall and the second side wall of the triangular shaped rack 100. A first partial side wall 101 and a second partial side wall 103 are connected to form the third side wall of the triangular shaped rack 100. The first partial side wall 101 and the second partial side wall 103 further contain slide mechanisms to reduce the inner area of the rack assembly 100 and thus tighten the formation of playing balls placed within said rack assembly 100.

Figure 2:
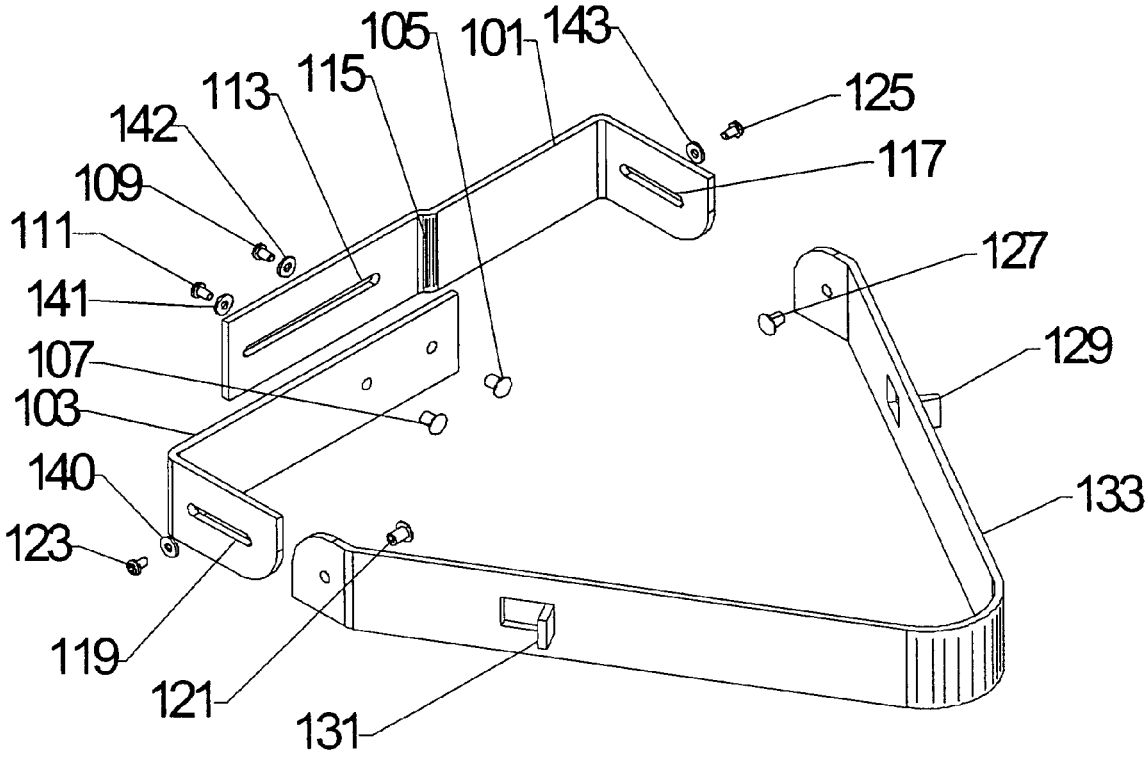
FIG. 2 is an exploded view of a ball setting and tightening rack according to one embodiment of the present invention.

Referring now to FIG. 2, an exploded view of a ball setting and tightening rack according to one embodiment of the present invention is shown. The compound side wall 133 makes up two of the three sides of the rack assembly 100. The compound side wall 133 is generally V-shaped, and the two terminating ends of the V are each bent obliquely at a slight angle of less than 45 degrees. The compound side wall 133 contains a first threaded insert 121 and a second threaded insert 127. The compound side wall 133 also contains a first tab 129 and a second tab 131 to facilitate hand retention of the triangular shaped rack 100. The first tab 129 and the second tab 131 may be cut away from the compound side wall 133 and bent perpendicular to the compound side wall, or the first tab 129 and the second tab 131 may be molded, mechanically, or chemically attached to the compound side wall 133.

The compound side wall 133 makes up two of the three sides of the triangular shaped rack 100, and the third side of the triangular shaped rack is made up of two partial side walls, a first partial side wall 101 and a second partial side wall 103. The first partial side wall 101 is bent to form a right angle and contains two slots, a y-axis compression slot 117 and an x-axis compression slot 113. The purpose of the y-axis compression slot 117 is to allow travel of the first partial side wall 101 and the second partial side wall 103 in the y-axis for compressing a formation of playing balls. The purpose of the x-axis compression slot 113 is to allow travel of the second partial side wall 103 in relation to the first partial side wall 101 in the x-axis for compressing a formation of playing balls in the x-axis. The first partial side wall 101 contains a bevel 115 to provide a smooth and continuous surface between the first partial side wall 101 and the second partial side wall 103 along the interior of the triangular shaped rack 100. The second partial side wall 103 is also bent to form a right angle, but contains one slot, a y-axis compression slot 119. The second partial side wall 103 contains two threaded inserts, an x-axis first threaded insert 105 and an x-axis second threaded insert 107.

The first partial side wall 101 and the second partial side wall 103 are connected using a first screw 109 and a second screw 111. Washers 141 and 142 are optionally used with said first screw 109 and said second screw 111. The first screw 109 and the second screw 111 are placed through the first partial side wall x-axis compression slot 113, and fastened to the second partial side wall using the threaded inserts 105 and 107. The clearance between the screws 109 and 111 and the threaded inserts 105 and 107 is such that the first partial side wall 101 and the second partial side wall 103 glide smoothly in the x-axis, and the screws 109 and 111 and the washers 141 and 142 travel freely along the length of the first partial side wall x-axis compression slot 113.

The first partial side wall 101 and the second partial side wall 103, once connected together, are further connected to the compound side wall 133. The first partial side wall 101 is connected to the compound side wall 133 by placing a first partial side wall y-axis screw 125 through the first partial side wall y-axis compression slot 117. The first partial side wall y-axis screw 125 is fastened to the compound side wall 133 using a compound side wall first threaded insert 127. The first partial side wall y-axis screw 125 may optionally contain a first partial side wall y-axis washer 143. The clearance between the first partial side wall y-axis screw 125 and the compound side wall second threaded insert 127 is such that the first partial side wall 101 and the compound side wall 133 glide smoothly in the y-axis, and the first partial side wall y-axis screw 125 and the first partial side wall y-axis washer 143 travel freely along the length of the first partial side wall y-axis compression slot 117.

The second partial side wall 103 is connected in a similar manner to the compound side wall 133 by placing a second partial side wall y-axis screw 123 through a second partial side wall y-axis compression slot 119, and fastened to the compound side wall 133 using the compound side wall first threaded insert 121. The second partial side wall y-axis screw 123 may optionally contain a second partial side wall y-axis washer 140. The clearance between the second partial side wall y-axis screw 123 and the compound side wall first threaded insert 121 is such that the second partial side wall 103 and the compound side wall 133 glide smoothly in the y-axis, and the second partial side wall y-axis screw 123 and the second partial side wall y-axis washer 140 travel freely along the length of the second partial side wall y-axis compression slot 119.

The first partial side wall 101 and the second partial side wall 103 may optionally contain handles, tabs, grips, or other such structures to assist in retaining the first partial side wall 101 and the second partial side wall 103 with one's fingers.

The compound side wall 133, the first partial side wall 101 and the second partial side wall 103 are made of a rigid and durable material such as molded graphite, wood, lexan, polypropylene, polystyrene, Acrylonitrile-butadiene-styrene, Polycarbonate, Nylon, Polyethylene-terephthalate, Acetal Resin (such as acetal polyoxymethylene (POM) resin, an example of which is the product manufactured by DUPONT™ under the trade name DELRIN®), Acrylic, metal, fiberglass, or another plastic material.

Figure 2A:
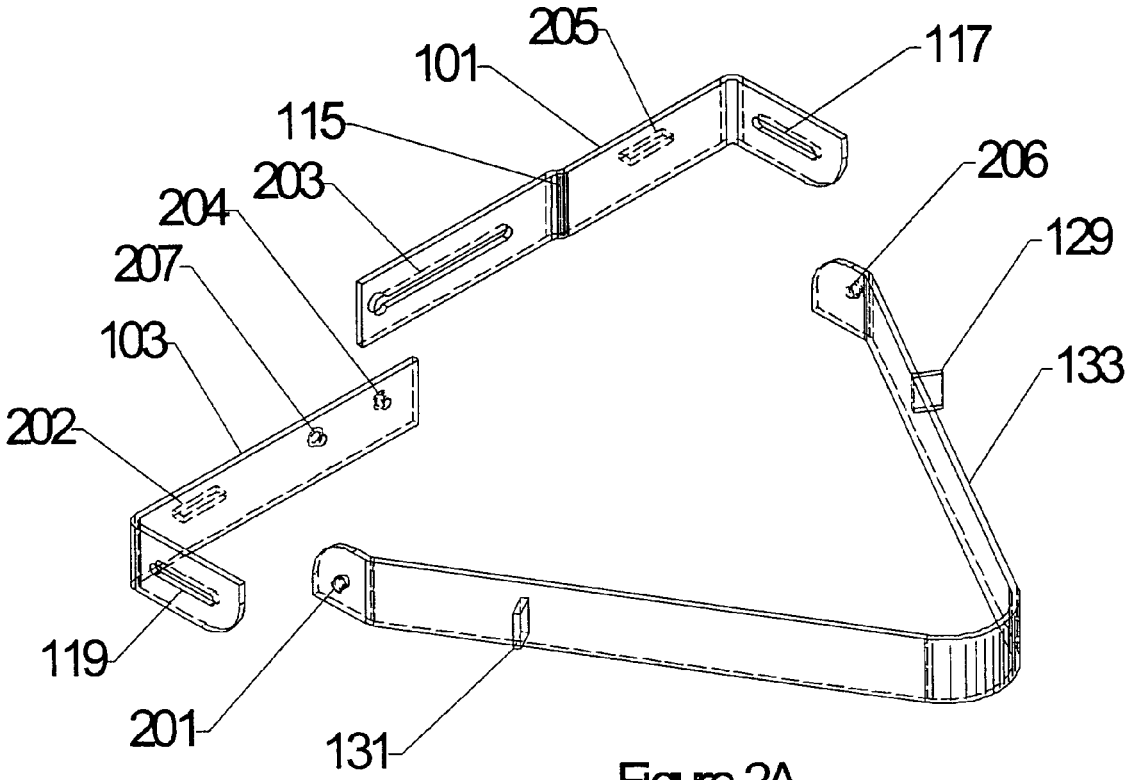
FIG. 2A is an exploded broken-away view of a ball setting and tightening rack according to another embodiment of the present invention.

Referring now to FIG. 2A, an exploded broken-away view of a ball setting and tightening rack according to another embodiment of the present invention is shown. The ball setting and tightening rack of FIG. 2A is similar to the ball setting and tightening rack shown in FIG. 2, except that the compound side wall 133, the first partial side wall 101 and the second partial side wall 103 are connected without the use of external hardware. The compound side wall 133 contains a first y-axis flange 201 and a second y-axis flange 206. The first y-axis flange 201 and the second y-axis flange 206 are integral to the compound side wall 133. The first y-axis flange 201 is shaped as a circle with two truncated arcs and is oriented such that the second partial side wall y-axis compression slot 119 will fit over the first y-axis flange 201 when properly aligned with said first y-axis flange 201, and will be securely retained on said first y-axis flange 201 when rotated. The second y-axis flange 206 is also shaped as a circle with two truncated arcs and is oriented such that the first partial side wall y-axis compression slot 117 will fit over the second y-axis flange 206 when properly aligned with said second y-axis flange 206, and will be securely retained on said second y-axis flange 206 when rotated.

The first partial side wall 101 contains a first handle 205 and the second partial side wall 103 contains a second handle 202. The first handle 205 and the second handle 202 are used to assist in raising the first partial side wall 101 and the second partial side wall 103 when removing the ball setting and tightening rack from the playing balls.

The first partial side wall 101 and the second partial side wall 103 are connected by placing a first x-axis flange 204 and a second x-axis flange 207 through the key slot first partial side wall x-axis compression slot 203. The compound side wall 133 is connected to the assembled first partial side wall 101 and second partial side wall 103 by placing the first y-axis flange 201 through the second partial side wall y-axis compression slot 119 and placing the second y-axis flange 206 through the first partial side wall y-axis compression slot 117.

Figure 2B:
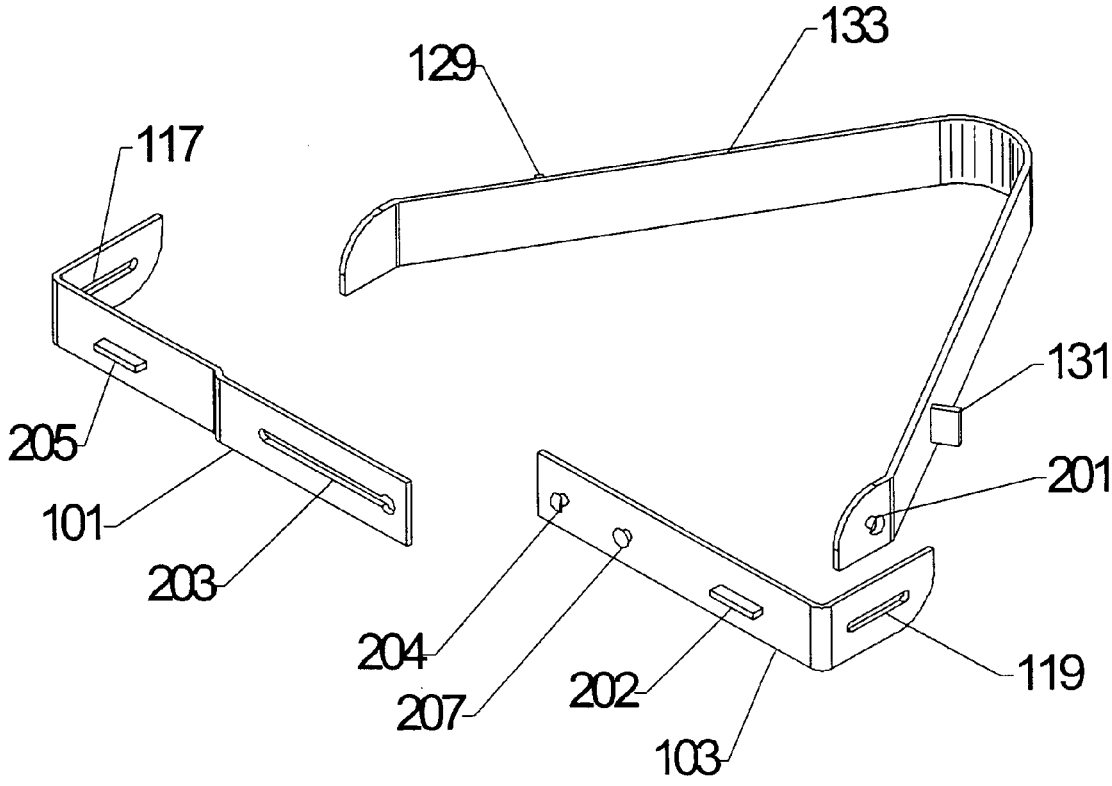
FIG. 2B is another exploded view of the ball setting and tightening rack of FIG. 2A.

FIG. 2B is another exploded view of the ball setting and tightening rack shown in FIG. 2A. FIG. 2B clearly shows the first x-axis flange 204 which is shaped as a circle with two truncated arcs, and the second x-axis flange 207 which is shaped as a circle. To join the first partial side wall 101 and the second partial side wall 103, the first x-axis flange 204 is inserted in the key slot first partial side wall x-axis compression slot 203 at an angle that allows for insertion. The second partial side wall 103 is then rotated to allow the second x-axis flange 207 to be inserted into the rounded end of the key slot first partial side wall x-axis compression slot 203.

Figure 3:
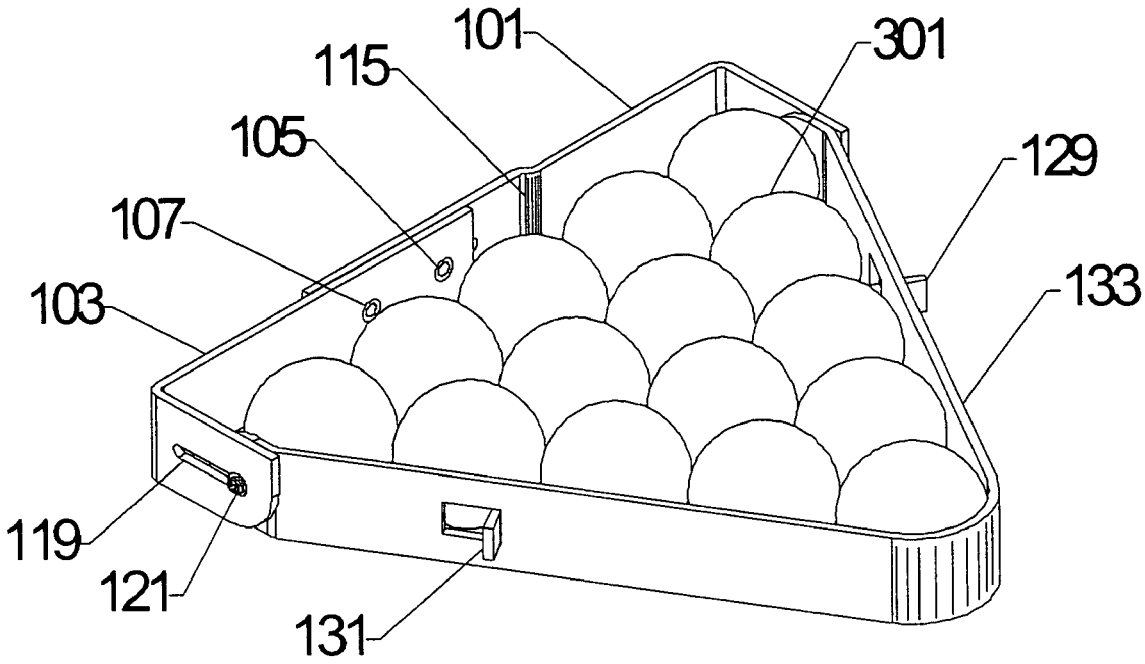
FIG. 3 illustrates the use of a ball setting and tightening rack according to one embodiment of the present invention.
Figure 5:
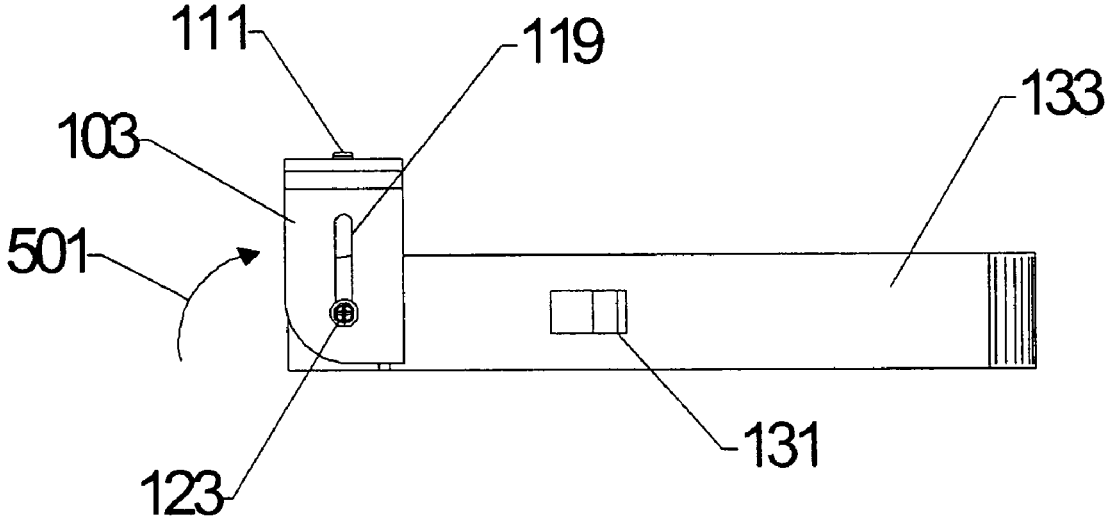
FIG. 5 is a side elevation view of a ball setting and tightening rack shown in the open position for release of playing balls.

Referring now to FIG. 3, a ball setting and tightening rack is shown in use. Playing balls 301 are placed within the confines of the ball setting and tightening rack. To tighten the formation of playing balls 301, the first partial side wall 101 and the second partial side wall 103 are pushed toward the compound side wall 133. Simultaneously, the first partial side wall 101 and the second partial side wall 103 are pushed toward each other along the x-axis. These two actions will compress the playing balls 301 tightly together. Once the compression action is complete, the first partial side wall 101 and the second partial side wall 103 are rotated upward, and the ball setting and tightening rack is slid forward, away from the formation of playing balls 301. FIG. 5 illustrates the upward rotation of the first partial side wall 101 and the second partial side wall 103. The first tab 129 and the second tab 131 can be used to hold the ball setting and tightening rack while compressing the playing ball formation and also while removing the ball setting and tightening rack from the formation of playing balls 301.

Figure 4:
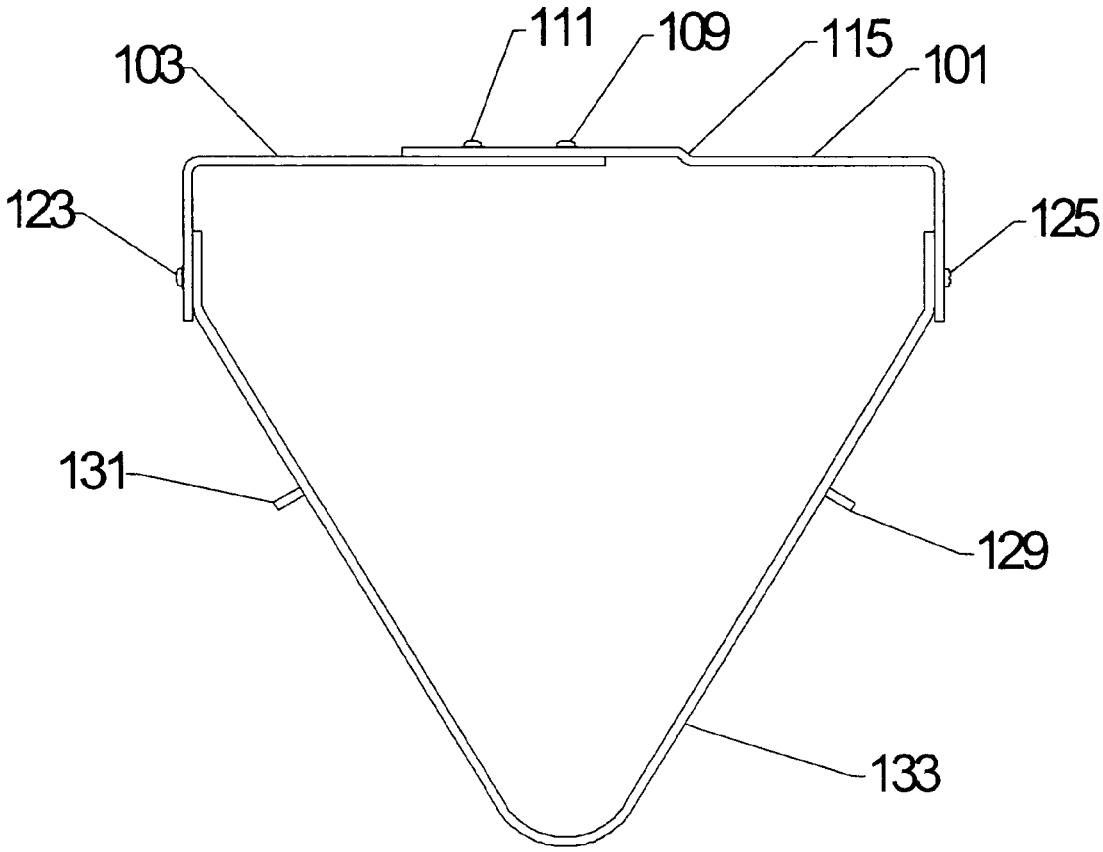
FIG. 4 is a top plan view of a ball setting and tightening rack according to one embodiment of the present invention.

FIG. 4 shows a top plan view of a ball setting and tightening rack according to one embodiment of the present invention.

FIG. 5 is a side elevation view of a ball setting and tightening rack shown in the open position for release of playing balls. Once playing balls are compressed, the first partial side wall 101 and the second partial side wall 103 are rotated upward, and the ball setting and tightening rack is slid forward, away from the formation of playing balls 301. The direction of rotation is illustrated as 501.

Figure 6:
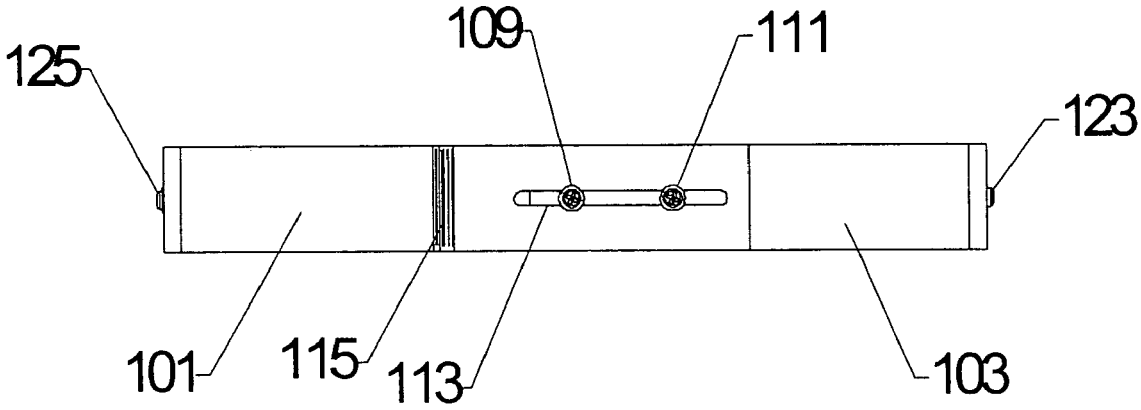
FIG. 6 is a rear elevation view of a ball setting and tightening rack according to one embodiment of the present invention.

FIG. 6 is a rear elevation view of a ball setting and tightening rack according to one embodiment of the present invention. The partial side wall x-axis compression slot 113 is shown with the x-axis first screw 109 and the x-axis second screw 111 in position within the partial side wall x-axis compression slot 113.

Figure 7:
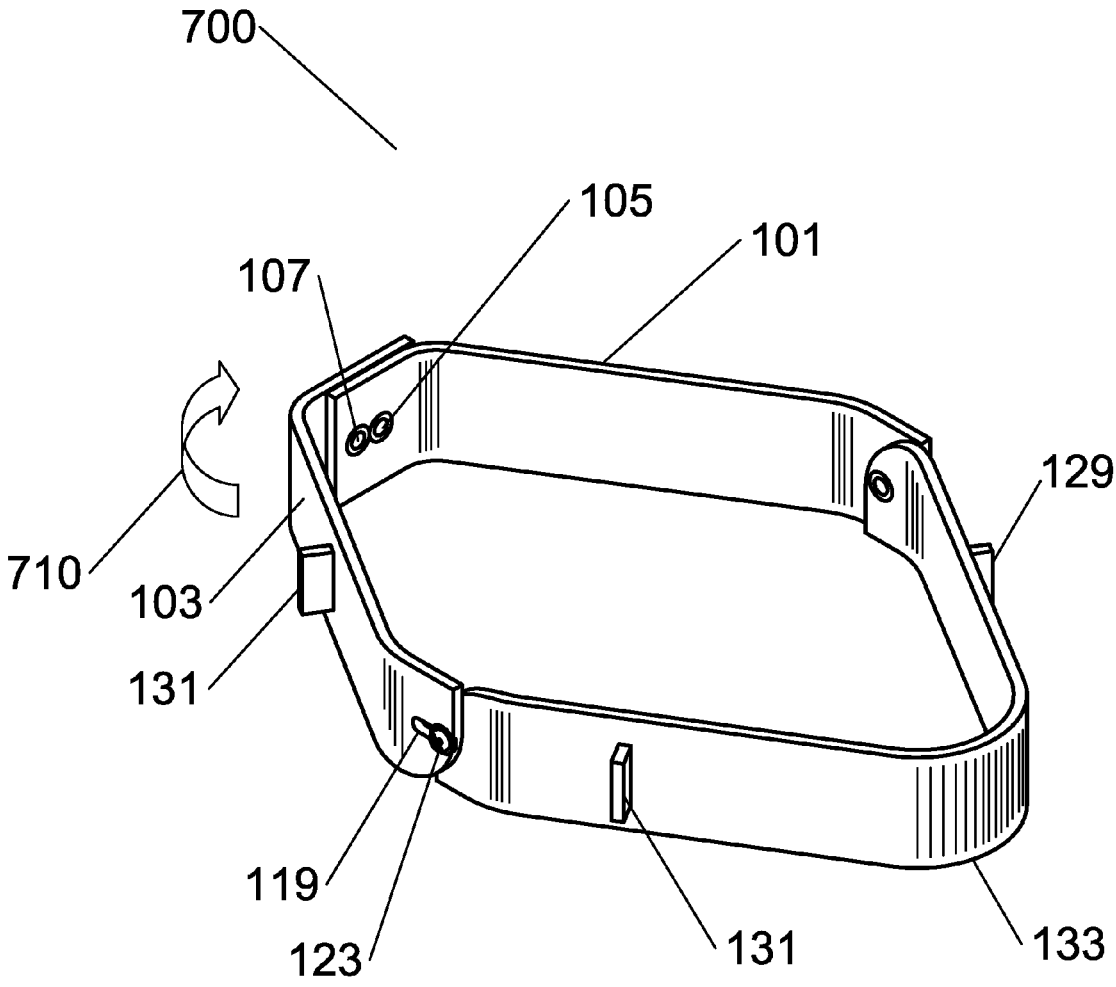
FIG. 7 is a perspective view of a ball setting and tightening rack according to another embodiment of the present invention.
Figure 8:
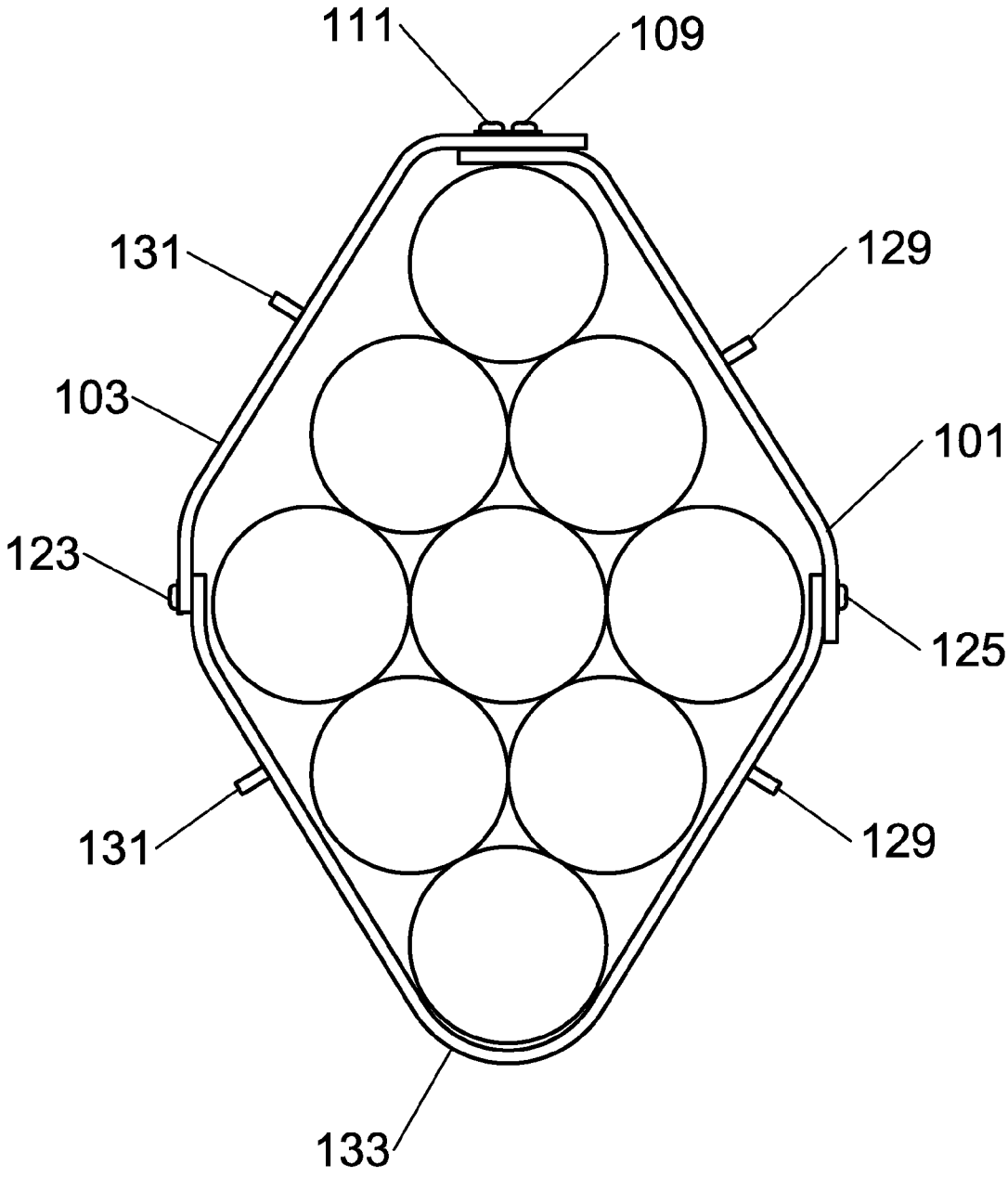
FIG. 8 is a top plan view of a ball setting and tightening rack of FIG. 7 in use, according to another embodiment of the present invention.
Figure 9:
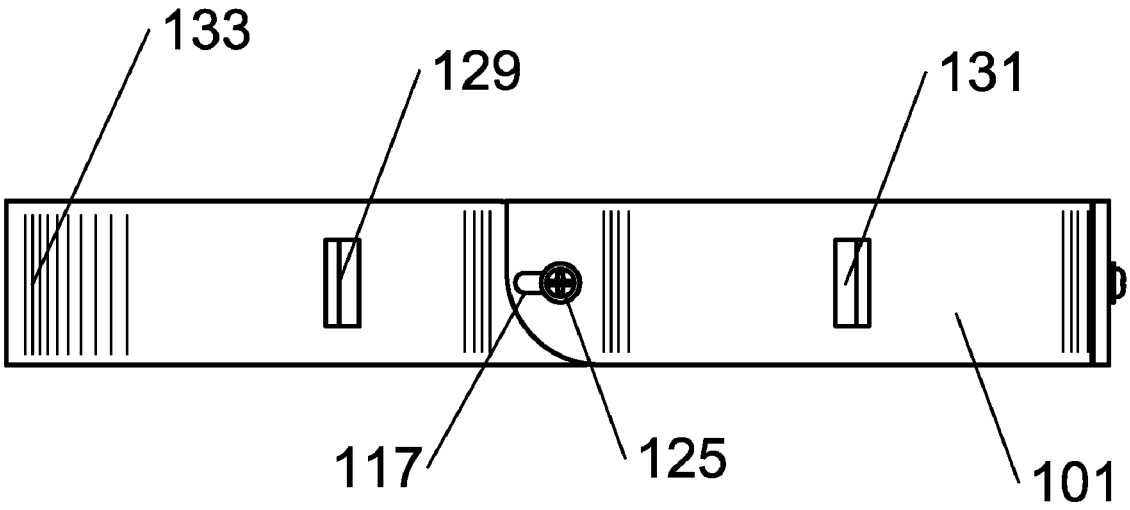
FIG. 9 is a side elevation view of a ball setting and tightening rack of FIG. 7, according to another embodiment of the present invention.
Figure 10:
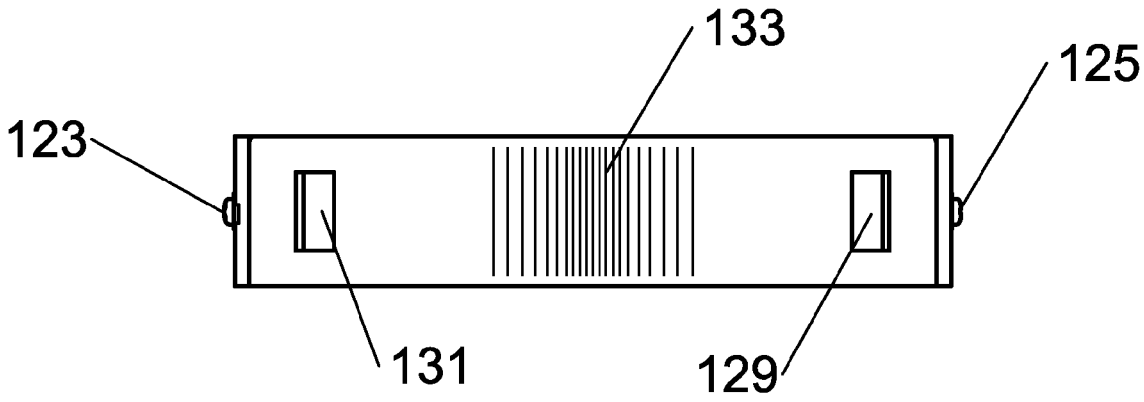
FIG. 10 is an end elevation view of a ball setting and tightening rack of FIG. 7, according to another embodiment of the present invention.

Referring now to FIG. 7, a ball setting and tightening rack according to another embodiment of the present invention is shown. FIG. 7 shows a diamond shaped rack assembly 700 that may be used to accommodate a grouping of 9 playing balls, a grouping that is commonly used in variations of the game of billiards such as 9 ball and snooker. As shown, a first partial side wall 101 and a second partial side wall 103 are connected to a compound side wall 133 using a slideable hinge mechanism that, in one embodiment of the present invention, is comprised of a slot 119 and a fastener 123. The assembly allows for the compaction of a grouping of playing balls, and subsequent horizontal removal of the assembly by raising the compound side wall 133 as shown by the direction of travel arrow 710, and sliding the assembly away from the compacted grouping of balls. FIG. 8 shows a plan view of the assembly in use. FIG. 9 shows a side view of the assembly, and FIG. 10 shows an end elevation view of the assembly.

It is, therefore, apparent that there has been provided, in accordance with the various objects of the present invention, an improved apparatus for creating a compact grouping of playing balls. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for arranging and compacting a plurality of playing balls into a predetermined pattern, comprising:

a frame comprising a first partial side wall and a second partial side wall each of which is adapted to receive the other; a slide mechanism disposed between the first partial side wall and the second partial side wall comprising an x-axis compression slot in the first partial side wall and a fastener connected to the second partial side wall for changing the combined length of the first partial side wall and the second partial side wall;

a compound side wall having an angular shape; and a slideable hinge mechanism comprising two or more slideable hinges, wherein each slideable hinge comprises a slot, a threaded insert and a screw, said slideable hinge mechanism being pivotally attached between the compound side wall and both the first partial side wall and the second partial side wall for changing the length of the compound side wall in relation to the first partial side wall and the second partial side wall and for allowing the first partial side wall and the second partial side wall to be raised above the compound side wall and the plurality of playing balls.

2. The apparatus as recited in claim 1, further comprising a tab extending outward from the compound side wall for facilitating hand retention of said apparatus.

3. The apparatus as recited in claim 1, wherein said frame is triangular.

4. The apparatus as recited in claim 1, wherein said frame is diamond-shaped.

5. The apparatus as recited in claim 1, wherein said screw is flanged.

6. The apparatus as recited in claim 5, wherein said slot is keyed to allow placement of said flanged screw into said slot.

7. The apparatus as recited in claim 5, wherein said flanged screw is shaped as a circle with truncated arcs.

8. A kit for building an improved ball setting and tightening rack, comprising:

a frame comprising a first partial side wall and a second partial side wall each of which is adapted to receive the other; a slide mechanism disposed between the first partial side wall and the second partial side wall comprising an x-axis compression slot in the first partial side wall and a fastener connected to the second partial side wall for changing the combined length of the first partial side wall and the second partial side wall;

a compound side wall having angular shape; and a slideable hinge mechanism comprising two or more slideable hinges, wherein each slideable hinge comprises a slot, a threaded insert and a screw, said slideable hinge mechanism being pivotally attached between the compound side wall and both the first partial side wall and the second partial side wall for changing the length of the compound side wall in relation to the first partial side wall and the second partial side wall and for allowing the first partial side wall and the second partial side wall to be raised above the compound side wall and the plurality of playing balls.

9. A method of arranging and compacting a plurality of playing balls within the apparatus as described in claim 1, said method comprising the steps of:

a. placing the plurality of playing balls within said apparatus;

b. reducing the length of at least one side wall by pushing at least one side wall toward said plurality of balls using said slideable hinge mechanism to compress said plurality of playing balls into a tight and compact grouping;

c. opening said apparatus using said slideable hinge mechanism to pivot the first partial side wall and the second partial side wall above the height of said plurality of playing balls and said compound side wall; and d. sliding said apparatus away from said plurality of playing balls.

* * * * *